US011365087B2

(12) United States Patent
Kuusinen et al.

(10) Patent No.: US 11,365,087 B2
(45) Date of Patent: Jun. 21, 2022

(54) FORECASTING ELEVATOR PASSENGER TRAFFIC

(71) Applicant: KONE Corporation, Helsinki (FI)

(72) Inventors: Juha-Matti Kuusinen, Helsinki (FI); Marja-Liisa Siikonen, Helsinki (FI); Juho Kokkala, Helsinki (FI)

(73) Assignee: KONE Corporation, Helsinki (FI)

( * ) Notice: Subject to any disclaimer, the term of this patent is extended or adjusted under 35 U.S.C. 154(b) by 810 days.

(21) Appl. No.: 16/235,899

(22) Filed: Dec. 28, 2018

(65) Prior Publication Data

US 2019/0202656 A1 Jul. 4, 2019

(30) Foreign Application Priority Data

Jan. 2, 2018 (EP) ..... 181500257

(51) Int. Cl.
*B66B 1/24* (2006.01)

(52) U.S. Cl.
CPC ..... *B66B 1/2408* (2013.01); *B66B 1/2458* (2013.01); *B66B 2201/234* (2013.01); *B66B 2201/235* (2013.01); *B66B 2201/243* (2013.01); *B66B 2201/401* (2013.01); *B66B 2201/402* (2013.01); *B66B 2201/403* (2013.01)

(58) Field of Classification Search
CPC ..... B66B 1/2408; B66B 1/2458; B66B 2201/234; B66B 2201/235; B66B 2201/243; B66B 2201/401; B66B 2201/402; B66B 2201/403; B66B 1/20; B66B 1/3476; B66B 3/02; B66B 5/0012; B66B 5/0018
See application file for complete search history.

(56) References Cited

U.S. PATENT DOCUMENTS 4,838,384 A 6/1989 Thangavelu
5,298,695 A * 3/1994 Bahjat ..... B66B 1/285 187/295
5,354,957 A * 10/1994 Robertson ..... B66B 1/2408 187/247

(Continued)

FOREIGN PATENT DOCUMENTS

CN 101837910 A 9/2010

OTHER PUBLICATIONS

Kokkala, "Elevator Passenger Traffic Forecasting with Bayesian Filtering", PoDoCo final report, Jun. 27, 2017, pp. 1-30. URL:http://www.juhokokkala.fi/podoco/report.pdf.

(Continued)

*Primary Examiner* — Jeffrey Donels
(74) *Attorney, Agent, or Firm* — Birch, Stewart, Kolasch & Birch, LLP

(57) ABSTRACT

According to an aspect, there is provided a method for forecasting elevator passenger traffic of an elevator group. The method comprises training a statistical traffic model describing a traffic profile for a specific cycle with historical timestamped origin-destination passenger counts, obtaining timestamped origin-destination passenger counts for a current cycle, generating an elevator passenger traffic forecast based on the trained statistical traffic model and the timestamped origin-destination passenger counts for the current cycle, and outputting the elevator passenger traffic forecast for use by an elevator group control.

14 Claims, 2 Drawing Sheets

(56) References Cited

U.S. PATENT DOCUMENTS

| | | | | | |
|---|---|---|---|---|---|
| 5,612,519 | A * | 3/1997 | Chenais | B66B 1/2458 | 187/380 |
| 5,767,462 | A * | 6/1998 | Thangavelu | B66B 1/2458 | 187/382 |
| 5,786,551 | A * | 7/1998 | Thangavelu | B66B 1/2458 | 187/380 |
| 9,834,405 | B2 * | 12/2017 | Nikovski | B66B 1/2458 | |
| 10,131,518 | B2 * | 11/2018 | Vuorenala | B66B 1/28 | |
| 2009/0050417 | A1 * | 2/2009 | de Groot | B66B 1/2458 | 187/387 |
| 2016/0130112 | A1 * | 5/2016 | Nikovski | B66B 1/2458 | 187/247 |

OTHER PUBLICATIONS

Kuusinen, "People Flow in Buildings—Evacuation Experiments and Modelling of Elevator Passenger Traffic", Doctoral Dissertation, May 22, 2015, Sections 3, 4.2. Total 43 pages.

* cited by examiner

FORECASTING ELEVATOR PASSENGER TRAFFIC

BACKGROUND

Elevator group control systems may use passenger traffic forecasts to avoid bad dispatching decisions in constantly changing traffic conditions. Forecasting future traffic can be implemented, for example, by using long-term historical traffic statistics. However, the long-term historical traffic statistics often fail to describe unexpected changes in the passenger traffic. This means, for example, that when unexpected changes occur, the long-term historical statistics may result in incorrect forecasts of the traffic. This can result in deterioration of elevator group performance.

Thus, it would be beneficial to have a solution that would alleviate at least one of these drawbacks.

SUMMARY

According to at least some of the aspects, a solution is provided that produces a forecast that is able to adapt to unexpected changes by combining historical traffic information and information based on the traffic observed during a current cycle of time, for example, a current day.

According to a first aspect of the invention, there is provided a method for forecasting elevator passenger traffic of an elevator group. The method comprises training a statistical traffic model describing a traffic profile for a specific cycle with historical origin-destination passenger counts; obtaining timestamped origin-destination passenger counts for a current cycle; generating an elevator passenger traffic forecast based on the trained statistical traffic model and the timestamped origin-destination passenger counts for the current cycle; and outputting the elevator passenger traffic forecast for use by an elevator group control.

In an embodiment, the timestamped origin-destination counts for the current cycle comprise origin-destination counts collected during the current day.

In an embodiment, additionally or alternatively, the method further comprises retraining the statistical traffic model with the time-stamped origin-destination counts of the current cycle.

In an embodiment, additionally or alternatively, the method further comprises further comprising filtering the origin-destination passenger counts for the current cycle using a Bayesian filtering algorithm.

In an embodiment, additionally or alternatively, the method further comprises estimating the origin-destination passenger counts from at least one of traffic measurements, landing calls, destination calls, car calls, and boarding and alighting passenger counts.

In an embodiment, additionally or alternatively, the method further comprises determining boarding and alighting passenger counts for estimating the origin-destination passenger counts with at least one of a load weighing device, a curtain of light, and a stereo camera installed inside the elevator car.

In an embodiment, additionally or alternatively, the elevator passenger traffic forecast comprises at least one of an origin-destination arrival rate, an incoming arrival rate, an interfloor arrival rate, and an outgoing arrival rate, and an arrival rate from a specific set of origin floors to a specific set of destination floors. The term "specific set" may refer to one or more origin floors and/or destination floors.

According to a second aspect of the invention, there is provided an apparatus for forecasting elevator passenger traffic of an elevator group. The apparatus comprises means for using historical timestamped origin-destination passenger counts to train a statistical traffic model describing a traffic profile for a specific cycle; means for obtaining timestamped origin-destination passenger counts for a current cycle; means for generating an elevator passenger traffic forecast based on the trained statistical traffic model and the timestamped origin-destination passenger counts for the current cycle; and means for outputting the elevator passenger traffic forecast for use by an elevator group control.

In an embodiment, the apparatus further comprises means for implementing any of the embodiments of the method of the first aspect.

According to a third aspect of the invention, there is provided an elevator system comprising an apparatus according to the second aspect.

According to a fourth aspect of the invention, there is provided a computer program comprising program code, which when executed by at least one processing unit, causes the at least one processing unit to perform the method of the first aspect.

In an embodiment, the computer program is embodied on a computer readable medium.

According to a fifth aspect, there is provided an apparatus for forecasting elevator passenger traffic of an elevator group. The apparatus comprises at least one processing unit and at least one memory. The at least one memory stores program instructions that, when executed by the at least one processing unit, cause the apparatus to train a statistical traffic model describing a traffic profile for a specific cycle with historical timestamped origin-destination passenger counts; obtain timestamped origin-destination passenger counts for a current cycle; generate an elevator passenger traffic forecast based on the trained statistical traffic model and the timestamped origin-destination passenger counts for the current cycle; and to output the elevator passenger traffic forecast for use by an elevator group control.

In an embodiment, the timestamped origin-destination counts for the current cycle comprise origin-destination counts collected during a current day.

In an embodiment, additionally or alternatively, the at least one memory stores program instructions that, when executed by the at least one processing unit, cause the apparatus to retrain the statistical traffic model with the time-stamped origin-destination counts of the current cycle.

In an embodiment, additionally or alternatively, the at least one memory stores program instructions that, when executed by the at least one processing unit, cause the apparatus to filter the origin-destination passenger counts for the current cycle using a Bayesian filtering algorithm.

In an embodiment, additionally or alternatively, the at least one memory stores program instructions that, when executed by the at least one processing unit, cause the apparatus to estimate the origin-destination passenger counts from at least one of traffic measurements, landing calls, destination calls, car calls, and boarding and alighting passenger counts.

In an embodiment, additionally or alternatively, the at least one memory stores program instructions that, when executed by the at least one processing unit, cause the apparatus to determine boarding and alighting passenger counts for estimating the origin-destination passenger counts with at least one of a load weighing device, a curtain of light, and a stereo camera installed inside the elevator car.

In an embodiment, additionally or alternatively, the elevator passenger traffic forecast comprises at least one of an origin-destination arrival rate, an incoming arrival rate, an interfloor arrival rate, and an outgoing arrival rate.

The above discussed means may be implemented, for example, using at least one processor, at least one processor and at least one memory connected to the at least one processor, or at least one processor, at least one memory connected to the at least one processor and an input/output interface connected to the at least one processor.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

The following description illustrates a solution that aims to improve the quality of traffic forecasts in an elevator system, and thus the performance of the elevator system. The solution produces a traffic forecast both based on obtained historical or long-term origin-destination (OD) passenger counts associated with a long time period (for example, days, weeks, months or years) and recent or short-term origin-destination counts associated with a time period close to the current time, for example, the current day.

Figure 1:
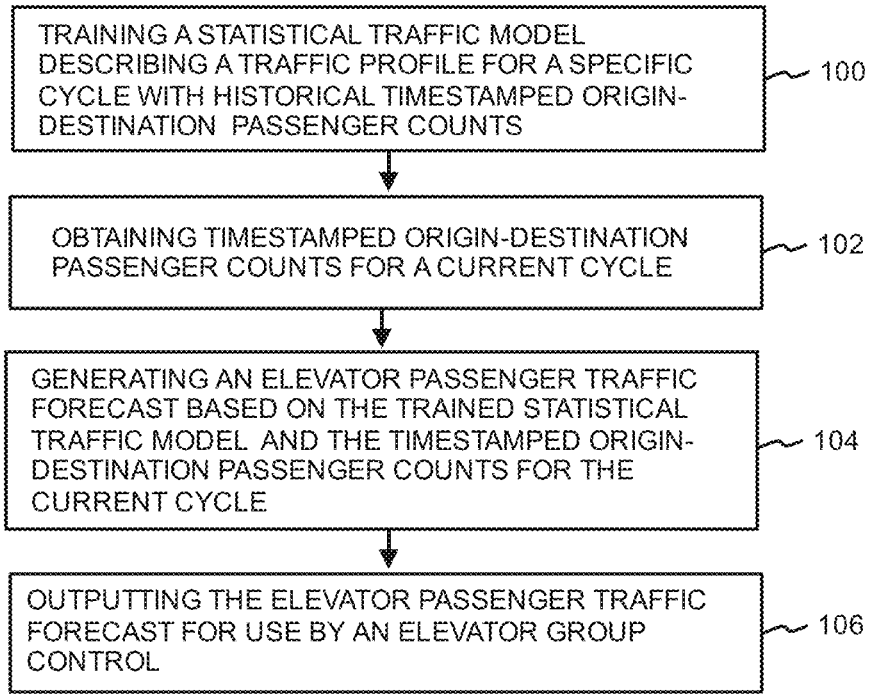
FIG. 1 illustrates a flow chart of a method for forecasting elevator passenger traffic according to an aspect.

FIG. 1 illustrates a flow chart of a method for forecasting elevator passenger traffic according to a first aspect.

At 100 a statistical traffic model describing a traffic profile for a specific cycle is trained with historical timestamped origin-destination passenger counts. The historical time-stamped origin-destination passenger counts may describe long-term historical traffic trends that can be used to forecast typical passenger traffic statistics, such as arrival intensities per floor and direction or origin-destination floor pair. The term "historical" or "long-term" may refer to a period time that includes a day, several days, weeks, months or even years. Thus, the historical timestamped origin-destination passenger counts relate to timestamped origin-destination passenger counts that concern multiple cycles within the period. The statistical traffic model describes a baseline traffic model for a specific cycle, e.g. a day or week, and a day-specific variation from the baseline. Training the statistical traffic model may refer to a process where the statistical traffic model is estimated from the long-term data. For example, the statistical traffic model may be pre-specified so that the exact model depends on some parameters, such as baseline intensity as a function of time or a parameter describing a magnitude of day-specific variation. When the statistical traffic model is trained with the long-term historical data, the historical data is used to find either the optimal parameters (using, for example, maximum likelihood or maximum a posteriori methods) or a distribution over parameters possibly represented as a sample of possible parameter values (using, for example, Markov chain Monte Carlo).

At 102 timestamped origin-destination passenger counts for a current cycle are obtained. The current cycle may refer, for example, to a current day, during which the recent traffic has been observed.

At 104 an elevator passenger traffic forecast is generated based on the trained statistical traffic model and the time-stamped origin-destination passenger counts for the current cycle. The trained statistical traffic model describes the traffic of a new cycle as a random process (probability distribution). The origin-destination passenger counts observed during the current cycle may be taken into account by approximating the conditional distribution of the statistical traffic model conditional on the traffic seen so far during the current cycle. For example, if the statistical traffic model is a state-space model where the latent state is traffic intensity, a Bayesian filtering algorithm may be used to maintain a probability distribution over the current intensity (based on observations so far) and generate forecasts as conditional expected values of the intensity of the next period.

As an example, the trained statistical traffic model may be combined with information determined based on traffic observed so far during the current day. Thus, the variations in the traffic pattern can be detected and reacted promptly. The statistical traffic model may be retrained with the time-stamped origin-destination counts of the current cycle, for example, during the night-time.

At 106 the elevator passenger traffic forecast is output for use by an elevator group control. Thus, instead of using only historical traffic statistics, the elevator group control has access to the elevator passenger traffic forecast that takes into account also short-term timestamped origin-destination passenger counts that not yet have been used to train the statistical traffic model.

In an embodiment, the elevator passenger traffic forecast comprises at least one of an origin-destination arrival rate, an incoming arrival rate, an interfloor arrival rate, and an outgoing arrival rate.

The above illustrated solution may provide at least some of the following effects. The generated enhanced elevator passenger traffic forecast provides more accurate information to the elevator group control at the time of call allocation, for example, to recognize traffic patterns such as up-peak, down-peak and two-way traffic. The forecast may also be utilized in call allocation to improve passenger service, or elevator wearing and energy consumption.

An origin-destination passenger count consists of passenger journeys. A passenger journey is a journey performed by a passenger with an elevator car, and may identify the origin and destination floors, and start and/or end time. The origin-destination passenger counts may be estimated from other traffic measurements, such as landing or destination calls, car calls, and boarding and alighting passenger counts. The boarding and alighting passenger counts may be determined using various sensors, such as an electronic load weighing device, a curtain of light or a stereo camera installed inside an elevator car. For example, if three passengers use the same elevator car to go from a floor A to a floor B, then there are three passenger journeys from the floor A to the floor B, and the origin-destination passenger count is three. Further, using this example, origin-destination passenger count data would then state "at [time] 3 passengers from floor A to B". The skilled person is aware of known solutions for determining origin-destination passenger counts, and thus they are not discussed here in more detail. One exemplary solution for determining the origin-destination passenger counts can be found in the granted patent FI121464B.

Figure 2:
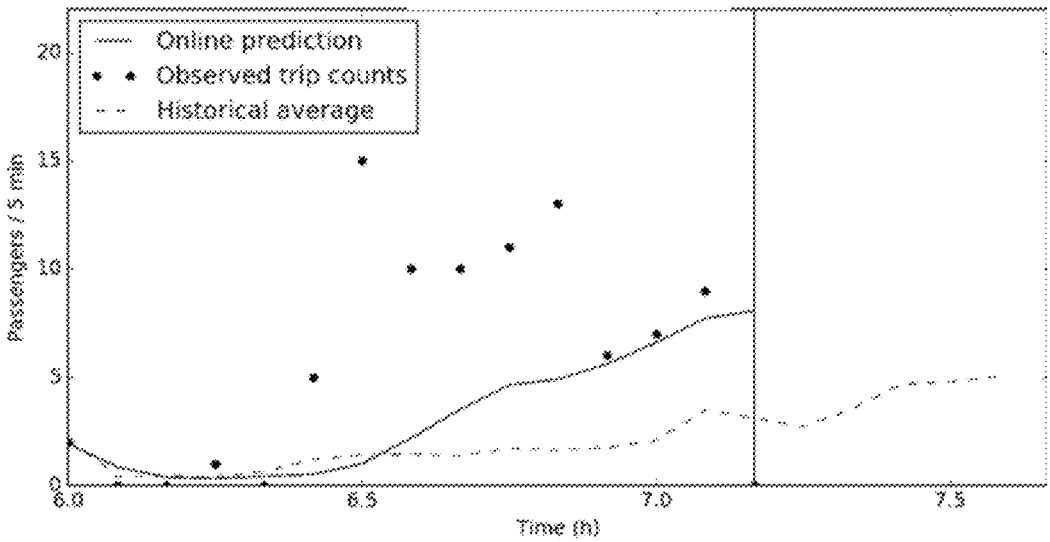
FIG. 2 illustrates a graph of forecasting an arrival rate of passenger traffic.

FIG. 2 illustrates a graph of forecasting an arrival rate of passenger traffic.

The graph illustrates estimating the incoming arrival rate based on a long-term historical average (dashed line) and short-term timestamped origin-destination passenger counts (solid line). In this example, the short-term timestamped origin-destination passenger counts have been filtered using a Bayesian filtering algorithm. The traffic counts may be aggregated into counts obtained during fixed-length intervals (such as 1 minute or 5 minutes), and a Bayesian filtering algorithm may be used to update the forecast for the intensity of the next interval, given the latest observed count. In FIG. 2, as an example, the observed counts during five minute intervals have been used to produce forecasts for the next five minute intervals. The dots represent the actual measured incoming traffic based on the origin-destination passenger counts. As can be seen, the combined solution is able to take into account the recent variations in the passenger traffic pattern and modify the elevator passenger traffic forecast accordingly.

As shown in FIG. 2, the generated forecast may provide a passenger arrival rate forecast. However, this is only one possible forecast example, and the forecast may relate to origin-destination passenger arrival rates or traffic component (for example, incoming, interfloor or outgoing) arrival rates or to some other statistic that can be computed and generated based on the origin-destination passenger counts.

Figure 3:
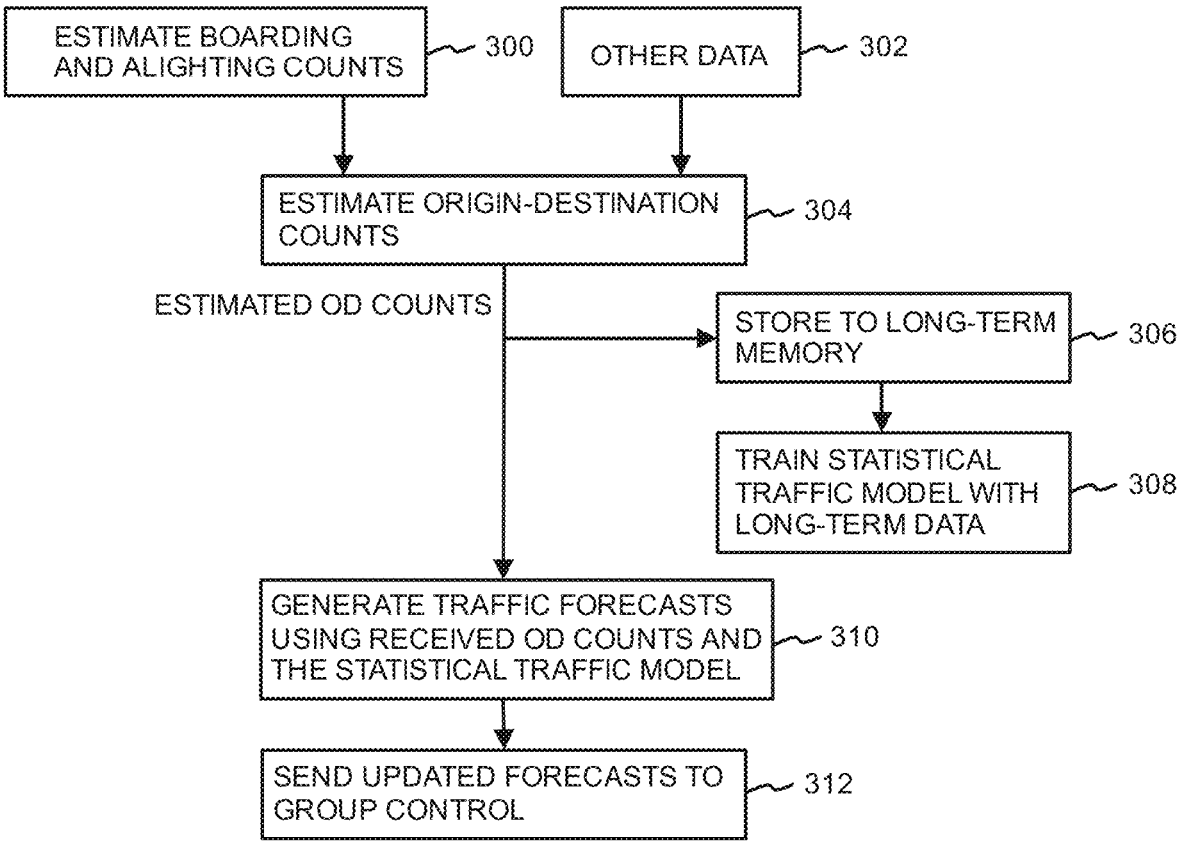
FIG. 3 illustrates a flow chart for forecasting elevator passenger traffic according to another aspect.

FIG. 3 illustrates a flow chart for forecasting elevator passenger traffic according to another aspect.

Origin-destination (OD) counts are estimated at 304. The origin-destination counts may be estimated by an OD estimation unit from other traffic measurements, such as landing or destination calls, car calls and elevator movement data (as illustrated by block 302), and boarding and alighting passenger counts (as illustrated by block 300). The boarding and alighting passenger counts may be determined using various sensors, such as an electronic load weighing device, a curtain of light or a stereo camera installed inside an elevator car. The skilled person is aware of known solutions for determining origin-destination passenger counts, and thus they are not discussed here in more detail. One exemplary solution for determining origin-destination passenger counts can be found in the granted patent FI121464B.

At 306 the estimated OD counts are stored in a long-term memory. The contents of the long-term memory may be used to retrain a statistical traffic model of a forecasting unit between subsequent cycles, as indicated by block 308. The term "cycle" refers to a specific time period, for example, a day or a week. The cycle may be divided into multiple intervals of time. Each interval may be a five minute interval or any other fixed interval. The retraining of the statistical traffic model may be performed at the start of each cycle with data stored during a previous cycle in the long-term memory. In an embodiment, old data already used to retrain the statistical traffic model may be deleted from the long-term memory in order to save memory space. The training may be "incremental" so that training results of the previous cycle can be used, thus enabling a solution that old data from cycles before the latest cycle need not be stored.

In an embodiment, the statistical traffic model is retrained with the current day's OD count data before a change occurs to a next cycle. For example, the statistical traffic model is retrained with the current day's OD count data during night-time.

The estimated OD counts are also fed to the forecasting unit. In an embodiment, a count aggregation unit maintains a counter of the number of passengers related to the relevant traffic component. When the count aggregation unit receives an OD count, it checks if it is related to the relevant traffic component, and if it relates to the relevant traffic component, the count aggregation unit increments a counter related to the relevant traffic component by the number of passengers. In an embodiment, at the start of every interval (for example, a five minute interval), the count aggregation unit sends the count of the counter to the forecasting unit.

As indicated by block 310, the forecasting unit is configured to generate traffic forecasts using the received OD counts and the statistical traffic model (trained at the block 308). The forecasting unit may have been initialized in the beginning of a present cycle (for example, a day) based on training results achieved at block 308. When a new passenger count is received at the start of every interval, the state of a forecaster (for example, as a conditional probability distribution) may be updated to take into account the received passenger count, the time elapsed after the start of the previous interval, and the current time of the day. As an example, let's assume that a previous forecast was for a time period of 10:55-11:00 and that the current time is now 11.00. Now the actually realized passenger count is known for the time period of 10:55-11:00 and a new passenger traffic forecast is calculated for the time period of 11:00-11:05. Thus, in addition to taking into account the realized passenger count, the passenger intensity has changed compared to the intensity during the previous time period of 10:55-11:00.

The forecasting unit then computes an updated forecast and sends the updated forecast to a group controller of an elevator system, as indicated by block 312. In other words, the forecasting may be based on the number of passengers counted during each interval, and the forecasting unit may send a new forecast to the group control at the start of each interval (for example, every five minutes).

In an embodiment, all the processing and calculations may be performed in the group controller of the elevator system. In another embodiment, some part, for example, the retraining of the statistical traffic model may be performed by a separate entity, for example, as a cloud service.

Figure 4:
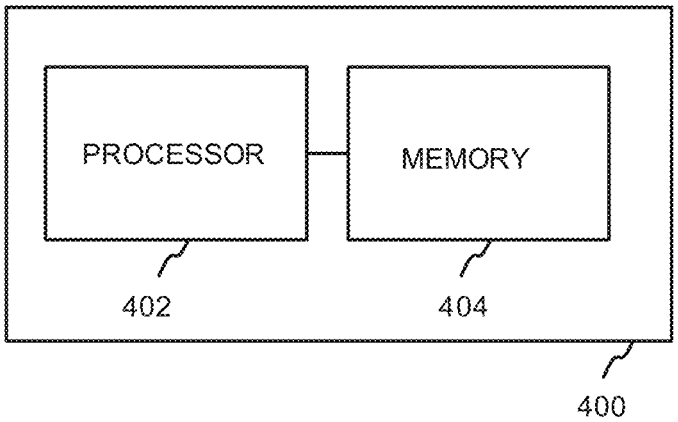
FIG. 4 illustrates a block diagram of an apparatus for forecasting elevator passenger traffic according to an aspect.

FIG. 4 illustrates a block diagram of an apparatus 400 for forecasting elevator passenger traffic according to an aspect.

The apparatus 400 comprises at least one processor 402 connected to at least one memory 304. The at least one memory 404 may comprise at least one computer program which, when executed by the processor 402 or processors, causes the apparatus 400 to perform the programmed functionality. In another embodiment, the at least one memory 404 may be an internal memory of the at least one processor 402.

The apparatus 400 may be a control entity configured to implement only the earlier discussed features, or it may be part of a larger elevator control entity, for example, an elevator controller or an elevator group controller.

In an embodiment, the at least one memory 404 may store program instructions that, when executed by the at least one processor 402, cause the apparatus 400 to train a statistical traffic model describing a traffic profile for a specific cycle with historical timestamped origin-destination passenger counts, obtain timestamped origin-destination passenger counts for a current cycle, generate an elevator passenger traffic forecast based on the trained statistical traffic model and the timestamped origin-destination passenger counts for the current cycle and output the elevator passenger traffic forecast for use by an elevator group control.

Further, in an embodiment, at least one of the processor 402 and the memory 404 may constitute means for training a statistical traffic model describing a traffic profile for a specific cycle with historical timestamped origin-destination passenger counts, means for obtaining timestamped origin-destination passenger counts for a current cycle, means for generating an elevator passenger traffic forecast based on the trained statistical traffic model and the timestamped origin-destination passenger counts for the current cycle, and means for outputting the elevator passenger traffic forecast for use by an elevator group control.

The exemplary embodiments and aspects of the invention can be included within any suitable device, for example, including, servers, workstations, capable of performing the processes of the exemplary embodiments. The exemplary embodiments may also store information relating to various processes described herein.

Example embodiments may be implemented in software, hardware, application logic or a combination of software, hardware and application logic. The example embodiments can store information relating to various methods described herein. This information can be stored in one or more memories, such as a hard disk, optical disk, magneto-optical disk, RAM, and the like. One or more databases can store the information used to implement the example embodiments. The databases can be organized using data structures (e.g., records, tables, arrays, fields, graphs, trees, lists, and the like) included in one or more memories or storage devices listed herein. The methods described with respect to the example embodiments can include appropriate data structures for storing data collected and/or generated by the methods of the devices and subsystems of the example embodiments in one or more databases.

All or a portion of the example embodiments can be conveniently implemented using one or more general purpose processors, microprocessors, digital signal processors, micro-controllers, and the like, programmed according to the teachings of the example embodiments, as will be appreciated by those skilled in the computer and/or software art(s). Appropriate software can be readily prepared by programmers of ordinary skill based on the teachings of the example embodiments, as will be appreciated by those skilled in the software art. In addition, the example embodiments can be implemented by the preparation of application-specific integrated circuits or by interconnecting an appropriate network of conventional component circuits, as will be appreciated by those skilled in the electrical art(s). Thus, the examples are not limited to any specific combination of hardware and/or software. Stored on any one or on a combination of computer readable media, the examples can include software for controlling the components of the example embodiments, for driving the components of the example embodiments, for enabling the components of the example embodiments to interact with a human user, and the like. Such computer readable media further can include a computer program for performing all or a portion (if processing is distributed) of the processing performed in implementing the example embodiments. Computer code devices of the examples may include any suitable interpretable or executable code mechanism, including but not limited to scripts, interpretable programs, dynamic link libraries (DLLs), Java classes and applets, complete executable programs, and the like.

As stated above, the components of the example embodiments may include computer readable medium or memories for holding instructions programmed according to the teachings and for holding data structures, tables, records, and/or other data described herein. In an example embodiment, the application logic, software or an instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer. A computer-readable medium may include a computer-readable storage medium that may be any media or means that can contain or store the instructions for use by or in connection with an instruction execution system, apparatus, or device, such as a computer. A computer readable medium can include any suitable medium that participates in providing instructions to a processor for execution. Such a medium can take many forms, including but not limited to, non-volatile media, volatile media, transmission media, and the like.

While there have been shown and described and pointed out fundamental novel features as applied to preferred embodiments thereof, it will be understood that various omissions and substitutions and changes in the form and details of the devices and methods described may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiments may be incorporated in any other disclosed or described or suggested form or embodiment as a general matter of design choice. Furthermore, in the claims means-plus-function clauses are intended to cover the structures described herein as performing the recited function and not only structural equivalents, but also equivalent structures.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

The invention claimed is:

1. A method for forecasting elevator passenger traffic of an elevator group, the method comprising:

training a statistical traffic model describing a traffic profile for a specific cycle with historical timestamped origin-destination passenger counts;

obtaining timestamped origin-destination passenger counts for a current cycle;

filtering the origin-destination passenger counts for the current cycle using a Bayesian filtering algorithm;

generating an elevator passenger traffic forecast based on the trained statistical traffic model and the timestamped origin-destination passenger counts for the current cycle; and outputting the elevator passenger traffic forecast for use by an elevator group control.

2. The method according to claim 1, wherein the timestamped origin-destination counts for the current cycle comprise data collected during the current day.

3. The method according to claim 1, further comprising: retraining the statistical traffic model with the timestamped origin-destination counts of the current cycle.

4. The method according to claim 1, further comprising: estimating the origin-destination passenger counts from at least one of traffic measurements, landing calls, destination calls, car calls, and boarding and alighting passenger counts.

5. The method according to claim 1, further comprising: determining boarding and alighting passenger counts for estimating the origin-destination passenger counts with at least one of a load weighing device, a curtain of light, and a stereo camera installed inside the elevator car.

6. The method according to claim 1, wherein the elevator passenger traffic forecast comprises at least one of an origin-destination arrival rate, an incoming arrival rate, an interfloor arrival rate, and an outgoing arrival rate.

7. An apparatus for forecasting elevator passenger traffic of an elevator group, the apparatus comprising:

means for training a statistical traffic model describing a traffic profile for a specific cycle with historical timestamped origin-destination passenger counts;

means for obtaining timestamped origin-destination passenger counts for a current cycle;

means for filtering the origin-destination passenger counts for the current cycle using a Bayesian filtering algorithm;

means for generating an elevator passenger traffic forecast based on the trained statistical traffic model and the timestamped origin-destination passenger counts for the current cycle; and means for outputting the elevator passenger traffic forecast for use by an elevator group control.

8. An elevator group control system comprising:

means for training a statistical traffic model describing a traffic profile for a specific cycle with historical timestamped origin-destination passenger counts;

means for obtaining timestamped origin-destination passenger counts for a current cycle;

means for filtering the origin-destination passenger counts for the current cycle using a Bayesian filtering algorithm;

means for generating an elevator passenger traffic forecast based on the trained statistical traffic model and the timestamped origin-destination passenger counts for the current cycle; and means for outputting the elevator passenger traffic forecast for use by an elevator group control.

9. A non-transitory computer readable medium having stored there on a computer program comprising program code, which when executed by at least one processing unit, causes the at least one processing unit to perform processes for training a statistical traffic model describing a traffic profile for a specific cycle with historical timestamped origin-destination passenger counts;

obtaining timestamped origin-destination passenger counts for a current cycle;

filtering the origin-destination passenger counts for the current cycle using a Bayesian filtering algorithm;

generating an elevator passenger traffic forecast based on the trained statistical traffic model and the timestamped origin-destination passenger counts for the current cycle; and outputting the elevator passenger traffic forecast for use by an elevator group control.

10. The method according to claim 2, further comprising: retraining the statistical traffic model with the timestamped origin-destination counts of the current cycle.

11. The method according to claim 2, further comprising: estimating the origin-destination passenger counts from at least one of traffic measurements, landing calls, destination calls, car calls, and boarding and alighting passenger counts.

12. The method according to claim 3, further comprising: estimating the origin-destination passenger counts from at least one of traffic measurements, landing calls, destination calls, car calls, and boarding and alighting passenger counts.

13. The method according to claim 2, further comprising: determining boarding and alighting passenger counts for estimating the origin-destination passenger counts with at least one of a load weighing device, a curtain of light, and a stereo camera installed inside the elevator car.

14. The method according to claim 3, further comprising: determining boarding and alighting passenger counts for estimating the origin-destination passenger counts with at least one of a load weighing device, a curtain of light, and a stereo camera installed inside the elevator car.

* * * * *